US007784110B2

(12) United States Patent
Jourde et al.

(10) Patent No.: US 7,784,110 B2
(45) Date of Patent: Aug. 31, 2010

(54) PROTECTIVE GLOVE WITH ANATOMICAL THUMB

(75) Inventors: Bastien Jourde, Montreal (CA); Martin Laberge, Montreal (CA); Pierre Paiement, St-Jerome (CA)

(73) Assignee: Sport Maska Inc., Montreal, Quebec (CA)

( * ) Notice: Subject to any disclaimer, the term of this patent is extended or adjusted under 35 U.S.C. 154(b) by 811 days.

(21) Appl. No.: 11/724,300

(22) Filed: Mar. 15, 2007

(65) Prior Publication Data

US 2008/0222763 A1 Sep. 18, 2008

(51) Int. Cl.
*A41D 19/00* (2006.01)

(52) U.S. Cl. ..... 2/161.1; 2/163

(58) Field of Classification Search ..... 2/16, 2/20, 163, 161.1; 602/21, 22
See application file for complete search history.

(56) References Cited

U.S. PATENT DOCUMENTS

| | | | | |
|---|---|---|---|---|
| 1,388,618 | A * | 8/1921 | Stein et al. | 2/21 |
| 1,951,190 | A * | 3/1934 | Gambee | 2/21 |
| 3,605,117 | A | 9/1971 | Latina | |
| 4,000,524 | A | 1/1977 | Rinehart | |
| 4,027,339 | A | 6/1977 | Brucker | |
| 4,507,804 | A * | 4/1985 | Consigny | 2/21 |
| 5,511,243 | A | 4/1996 | Hall et al. | |
| 5,822,796 | A | 10/1998 | Harges, Jr. et al. | |
| 5,884,329 | A | 3/1999 | Goldsmith et al. | |
| 5,946,720 | A | 9/1999 | Sauriol | |
| 5,983,396 | A | 11/1999 | Morrow et al. | |
| 5,987,646 | A | 11/1999 | Bolmer | |
| 5,996,117 | A | 12/1999 | Goldsmith et al. | |
| 6,532,963 | B2 * | 3/2003 | Swanbeck | 128/880 |
| 6,543,057 | B2 | 4/2003 | Beland et al. | |
| 6,550,069 | B1 | 4/2003 | Morrow | |
| 6,584,615 | B1 | 7/2003 | Wilder et al. | |
| 6,732,376 | B2 | 5/2004 | Hoffman | |
| 6,813,780 | B2 | 11/2004 | Morrow | |
| 6,813,781 | B2 * | 11/2004 | Wilder et al. | 2/161.1 |
| 6,990,690 | B2 | 1/2006 | Gait | |
| 2004/0187190 | A1 | 9/2004 | Wilder et al. | |
| 2005/0066412 | A1 | 3/2005 | Morrow | |
| 2005/0114984 | A1 | 6/2005 | Morrow et al. | |
| 2005/0251893 | A1 | 11/2005 | Hayden et al. | |
| 2006/0090242 | A1 | 5/2006 | Zuckerwar | |

* cited by examiner

*Primary Examiner*—Katherine Moran
(74) *Attorney, Agent, or Firm*—Ogilvy Renault LLP

(57) ABSTRACT

A protective glove having a thumb portion having at least two dorsal protective members for protecting a back portion of a thumb, adjacent ones of the dorsal protective members being pivotable with respect to one another about a respective axis between an extended position and a folded position, the respective axis being angled with respect to a perpendicular to a longitudinal axis of the thumb portion.

19 Claims, 7 Drawing Sheets

PROTECTIVE GLOVE WITH ANATOMICAL THUMB

FIELD OF THE INVENTION

The present invention relates to gloves, and more particularly to a protective glove having improved thumb protection.

BACKGROUND ART

Protective gloves such as hockey gloves usually include protective members protecting at least a dorsal side of the hand and fingers contained therein. The protective members usually include some means of articulation, for example break lines between adjacent protective pads, such as to allow bending of the fingers protected by the glove.

However, thumb portions of such gloves usually include break lines between adjacent protective pads extending perpendicularly to a longitudinal axis of the thumb portion, thus guiding the thumb to fold linearly, i.e. along an axis perpendicular to the longitudinal axis of the thumb portion. Such a folding motion generally does not conform to the thumb's gripping motion. As such, the position of the thumb within the folded thumb portion generally does not provide for an optimal stick gripping position.

Accordingly, improvements are desirable.

SUMMARY OF INVENTION

It is therefore an aim of the present invention to provide an improved protective glove.

Therefore, in accordance with the present invention, there is provided a protective glove having a thumb portion for receiving a thumb therein, the thumb portion comprising at least two dorsal protective members for protecting a back portion of a thumb, adjacent ones of the dorsal protective members being pivotable with respect to one another about a respective axis between an extended position and a folded position, the respective axis being angled with respect to a perpendicular to a longitudinal axis of the thumb portion.

Also in accordance with the present invention, there is provided a protective glove including a thumb portion for receiving and protecting a thumb, the thumb portion including at least two protective members providing impact protection to a dorsal side of the thumb, the protective members being pivotable relative to one another to articulate the thumb portion between a folded position and an extended position, the rigid protective members pivoting toward the folded position in a non-linear manner.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
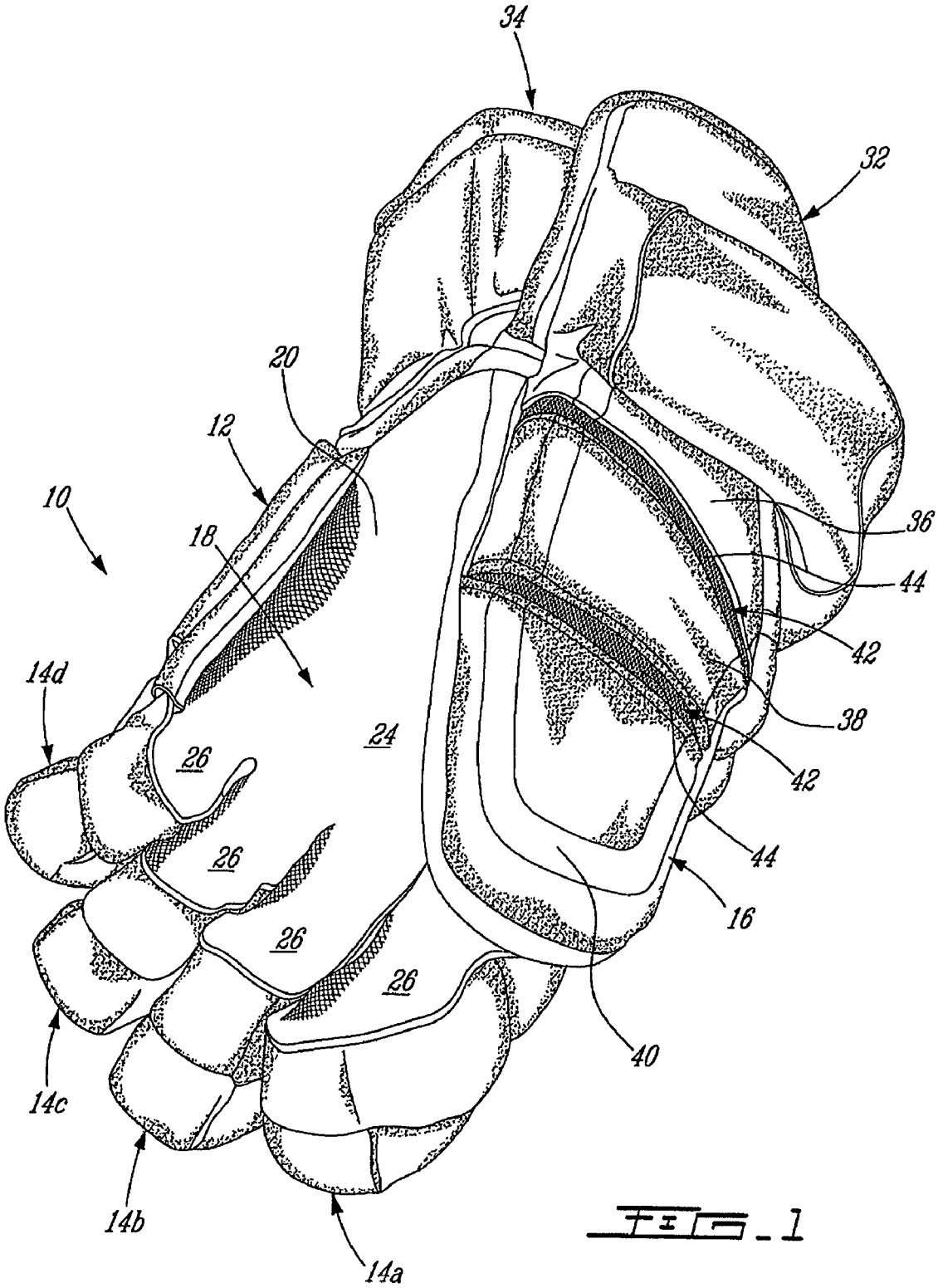
FIG. 1 is a perspective view of a protective glove according to a particular embodiment of the present invention.

Referring to FIG. 1, a protective hockey glove 10 according to a particular embodiment of the present invention generally comprises a hand-receiving portion 12 adapted to receive a hand of a wearer. In the embodiment shown, the hand-receiving portion 12 includes four finger portions 14*a,b,c,d* and a thumb portion 16 which extend from a main glove body 18. The hand-receiving portion 12 includes an inner palm side 20 generally covering the palm of the wearer's hand, and an opposed padded outer dorsal side 22 (see FIG. 2) generally covering the back side of the wearer's hand. In alternate embodiments which are not shown, the glove 10 can have less than four finger portions with at least one of the finger portions receiving more than one finger therein.

Although the protective glove 10 as depicted and described in further detail below is particularly intended for use as a hockey glove, it is to be understood that the protective glove 10 of the present invention can be used for other types of activities during which protection of the hands is desired, such as for example in other contact stick sports like lacrosse or for operating motorized vehicles such as motorcycles, snowmobiles and the like.

The inner palm side 20 of the glove 10 includes a main palm portion 24 which in a particular embodiment is composed of a relatively robust and durable material such as natural leather or a synthetic version thereof. As the wearer regularly grasps a stick (such as a hockey stick for example) when wearing the protective athletic glove 10, this main palm portion 24 therefore provides a good grip on the stick's shaft and/or handle while being relatively resistant to wear which can occur from frequent sliding of the glove 10 down the stick or rotation of the stick within the wearer's gloved hands. Finger palm portions 26 are integral with and extend from the central main palm portion 24, and are formed of the same durable material as described above. In an alternate embodiment, the finger palm portions 26 are separate from the main palm portion 24 and are optionally made from a different material.

The palm portions 24, 26 can also include ventilation openings (not shown), which are preferably covered by any type of appropriate material such as, for example, mesh material.

Figure 2:
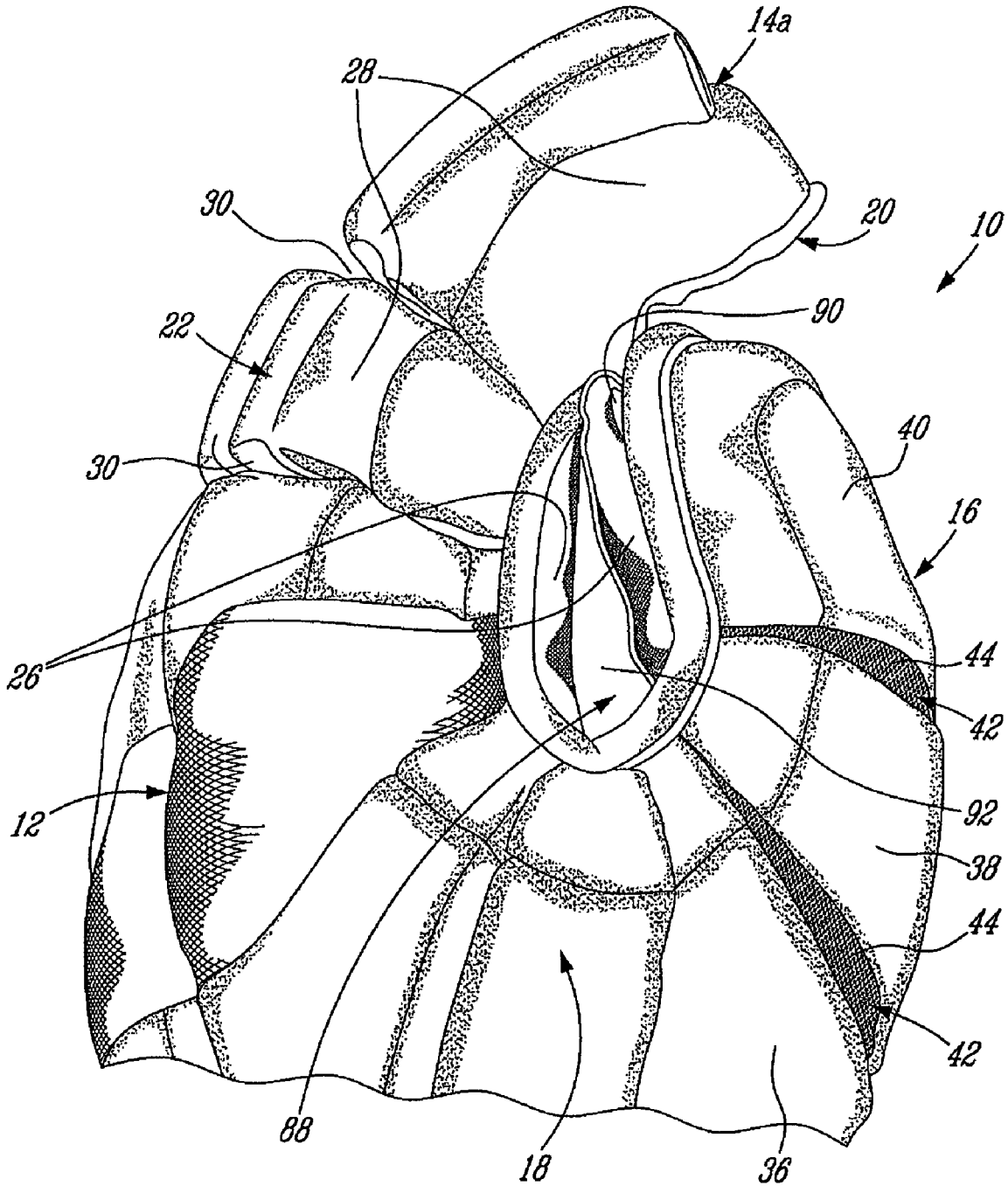
FIG. 2 is a side view of the glove of FIG. 1.

Referring to FIG. 2, the outer dorsal side 22 of the hand-receiving portion 12 includes a plurality of pads 28 extending from the main glove body 18 and the finger portions 14*a,b,c,d*. In a particular embodiment, each pad 28 is attached to the hand-receiving portion 12 in a separate envelope. Break lines 30 defined between adjacent envelopes in the finger portions 14*a,b,c,d* are provided generally over the joints of the fingers such as to maximize flexibility of the glove 10.

Referring back to FIG. 1, the glove 10 also includes a wrist cuff 32 which at least partially circumscribes an opening 34 of the hand-receiving portion 12 within which the user's hand is inserted for putting on the glove 10.

Referring to FIGS. 1-2, the thumb portion 16 includes three dorsal protective members protecting a back side of the thumb: a base protective member 36, a central protective member 38 and a tip protective member 40. The protective members 36, 38, 40 offer protection from injury which can be caused for example by the impact of a stick on the dorsal side of the thumb portion 16. Each protective member 36, 38, 40 is pivotable with respect to the adjacent protective member(s) 36, 38, 40 such that the thumb portion 16 can be articulated between an extended position and a folded position, the folded position being shown in FIG. 2. A gap 42 is created between the adjacent protective members 36, 38, 40 when the thumb portion 16 is folded, and the thumb portion 16 further includes a layer of material 44, which is for example an extensible mesh material, extending across each gap 42 to cover it.

Figure 4:
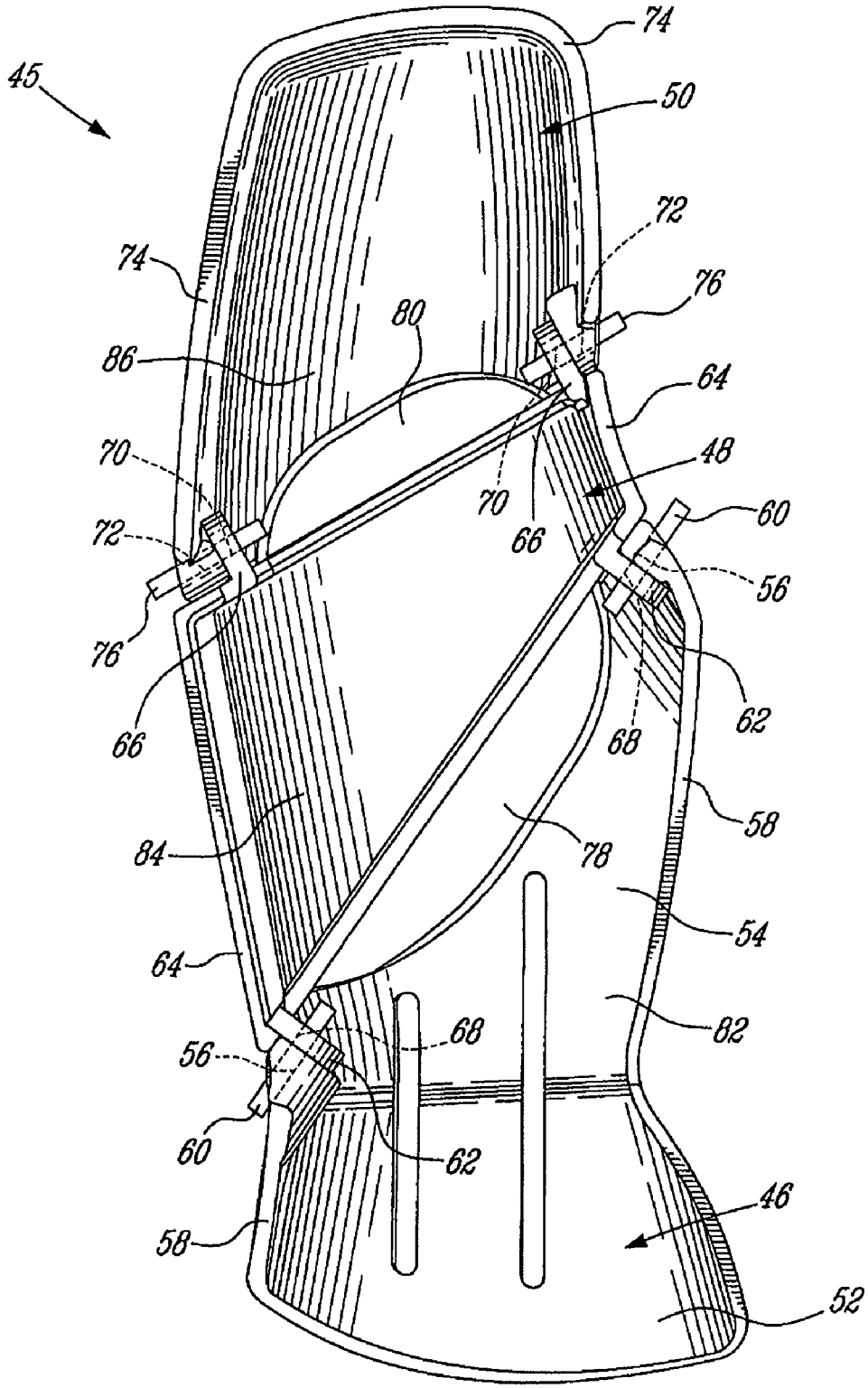
FIG. 4 is a bottom view of the part of FIG. 3.

Referring to FIG. 4, the thumb portion 16 includes a rigid assembly 45 which includes base, central and tip rigid frame 46, 48, 50 respectively included in the base, central and tip protective members 36, 38, 40. The frames 46, 48, 50 preferably have a curved cross-section such as to at least partially cover the sides of the thumb. The base frame 46 includes a wrist portion 52 covering part of the wrist of the wearer, and a metacarpal portion 54 covering the base of the thumb. The base frame 46 includes two aligned holes 56 defined in opposed side walls 58 thereof, adjacent the end of the metacarpal portion 54, for receiving a pair of first pivots 60 therethrough.

Figure 5:
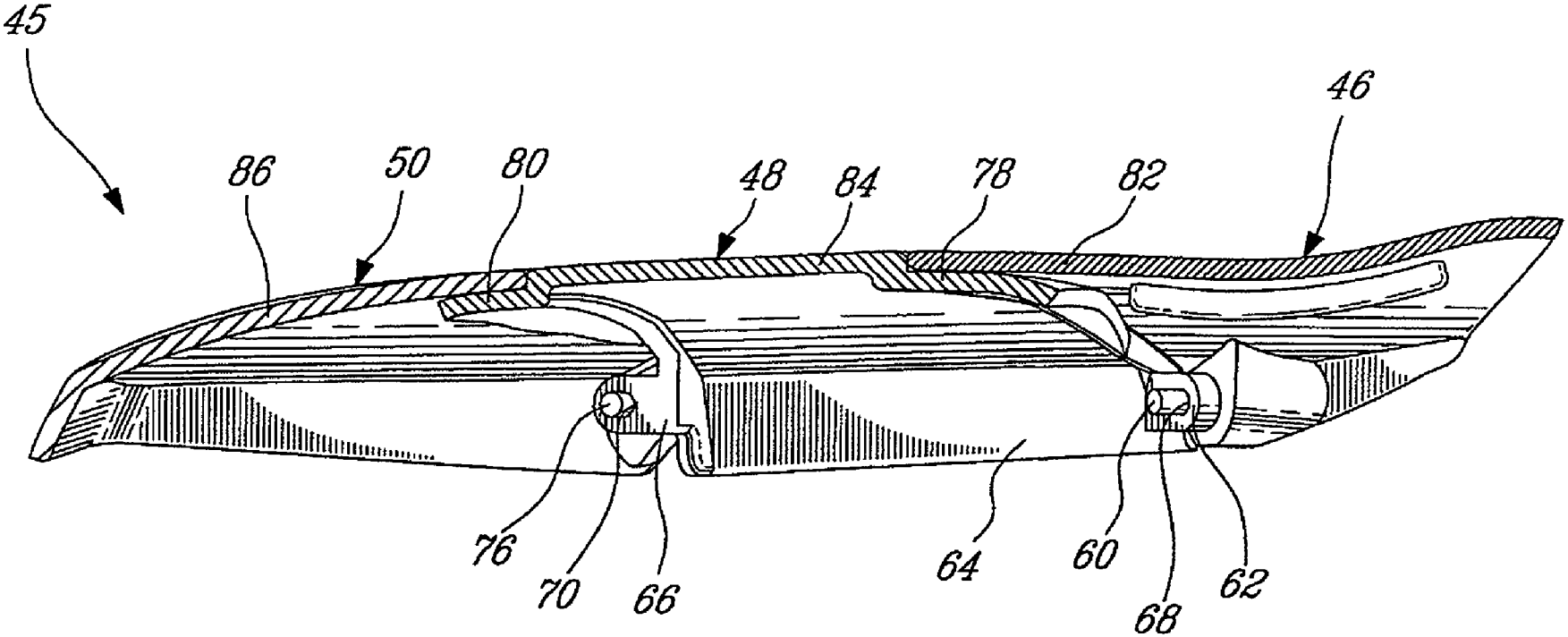
FIG. 5 is a cross-sectional view of the part of FIG. 3, taken along a longitudinal axis thereof.

Referring to FIGS. 4-5, the central frame 48 covers the proximal phalanx of the thumb, and includes a first pair of arms 62 protruding from opposed side walls 64 thereof at a proximal end thereof, and a second pair of arms 66 protruding from the side walls 64 at a distal end thereof. Aligned holes 68, 70 are defined through the arms 62, 66 of each pair. The proximal end of the central frame 48 is connected to the end of the metacarpal portion 54 of the base frame 46 by the pair of first pivots 60 received within the aligned holes 56, 68 in the two adjacent frames 46, 48. As can be seen from FIG. 5, the pivots 60 and aligned holes 56, 68 are located adjacent a palm side of the frames 46, 48.

Referring to FIG. 4, the tip frame 50 covers the distal phalanx of the thumb, and includes two aligned holes 72 defined in opposed side walls 74 thereof near a proximal end thereof, with the opposed end of the tip frame 50 being preferably curved to protect the tip of the thumb. The distal end of the central frame 48 is connected to the proximal end of the tip frame 50 by a pair of second pivots 76 (see also FIG. 5) received within the aligned holes 70, 72 in the two adjacent frames 48, 50. As can be seen from FIG. 5, the pivots 76 and aligned holes 70, 72 are located adjacent a palm side of the frames 48, 50.

In a particular embodiment, the frames 46, 48, 50 are made of high density polyethylene. Alternate materials for the frames include adequate types of injectable plastics such as for example polycarbonate, composite materials, etc.

As such, the central protective member 38 is pivotally connected to the base protective member 36 by the first pivots 60, and the tip protective member 40 is pivotally connected to the central protective member 38 by the second pivots 76.

In a particular embodiment and as shown in FIGS. 4-5, the central frame 48 also includes opposed locking members 78, 80 protruding from the ends thereof toward the base and tip frames 46, 50. In the extended position shown for example in FIG. 5, dorsal walls 82, 84, 86 of the frames 46, 48, 50 are aligned, and the locking members 78, 80 abut an underside of the dorsal wall 82, 86 of the base and tip frames 46, 50 such as to prevent the protective members 36, 38, 40 from rotating away from the folded position beyond the extended position.

Referring to FIG. 2, the thumb portion 16 also includes a thumb pocket 88 for receiving the thumb therein, the thumb pocket 88 being connected to the protective members 36, 38, 40 along a tip 90 and a base 92 thereof, with the portion of the thumb pocket between the tip and base 90, 92 being free from the protective members 36, 38, 40.

Padding (not shown) is preferably added to the frames 46, 48, 50 at least along the underside of the dorsal walls 82, 84, 86, between each frame 46, 48, 50 and the thumb pocket 88, such as to define the respective protective members 36, 38, 40. The protective members 36, 38, 40 also preferably include an appropriate layer of material covering the frames 46, 48, 50, and padding can optionally be included between the outer surface of the dorsal and side walls 82, 84, 86, 58, 64, 74 and the layer of material. The layer of material covering the palm side 24 of the thumb portion 16 is preferably continuous, i.e. extends across the three protective members 36, 38, 40.

Figure 3:
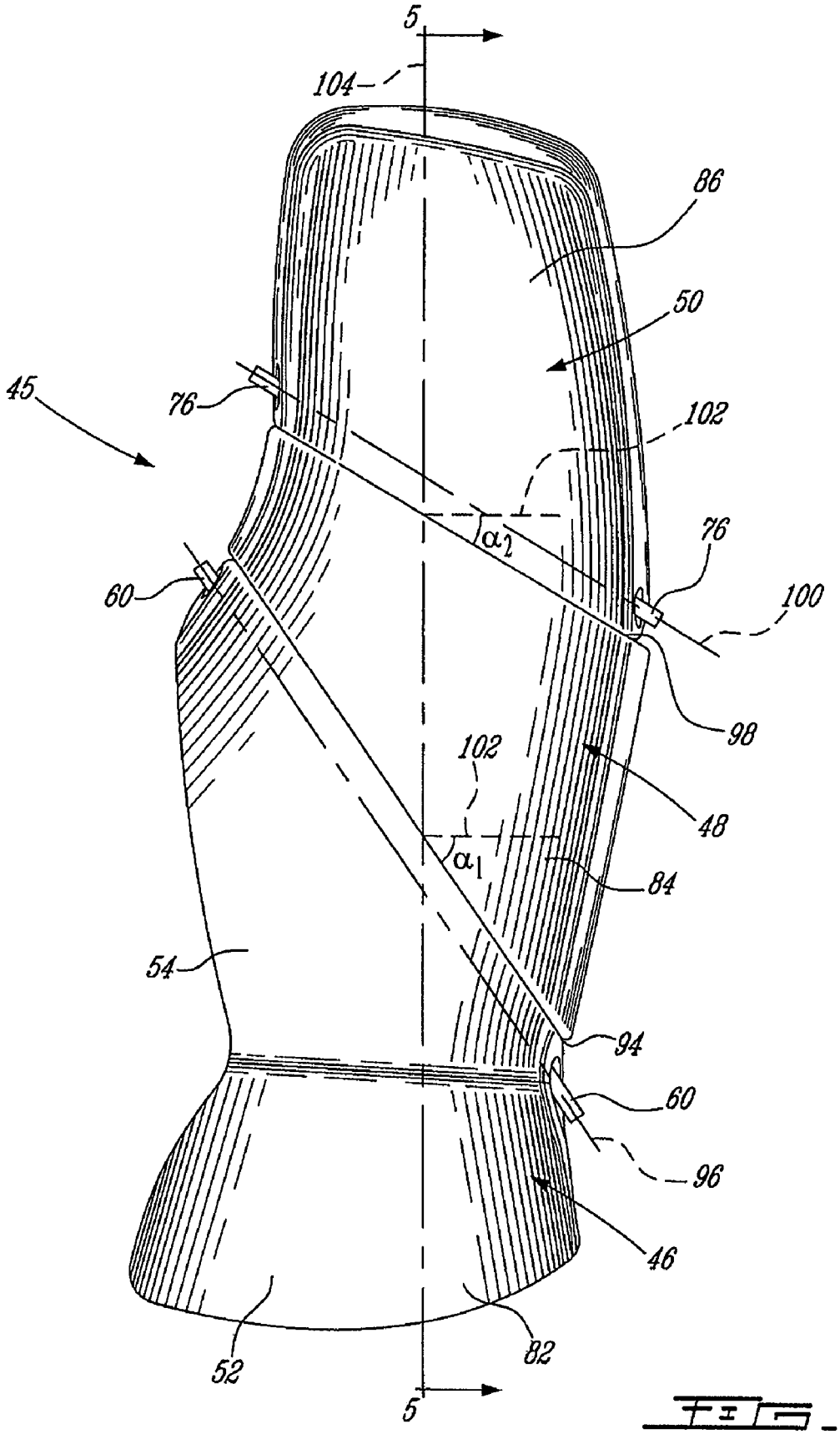
FIG. 3 is top view of part of a thumb portion of the glove of FIG. 1 according to a particular embodiment of the present invention.

Referring to FIG. 3, a first break line 94 is defined between the base frame 46 and the central frame 48, and as such between the corresponding protective members 36, 38. The first break line 94 is substantially parallel or parallel to a first axis of rotation 96 defined by the first pivots 60. A second break line 98 is defined between the central frame 48 and the tip frame 50, and as such between the corresponding protective members 38, 40. The second break line 98 is substantially parallel or parallel to a second axis of rotation 100 defined by the second pivots 76. The break lines 94, 98 and as such the axes of rotation 96, 100 are angled with respect to a corresponding transversal axis 102 extending perpendicularly to the longitudinal axis 104 of the thumb portion 16.

Referring back to FIG. 3, the first break line 94, and as such the axis of rotation 96 of the first pivots 60, forms an angle $\alpha_1$ with the transversal axis 102, and the second break line 98, and as such the axis of rotation 100 of the second pivots 76, forms an angle $\alpha_2$ with the transversal axis 102. In the embodiment shown, $\alpha_1$ is larger than $\alpha_2$. In a particular embodiment, both $\alpha_1$ and $\alpha_2$ are at least 20°, and $\alpha_1$ is preferably at least 45°. In a particular embodiment, $\alpha_1$ is approximately 55°, and $\alpha_2$ is approximately 30°. Such a configuration provides for the thumb portion 16 to fold in proper position for a typical hockey stick gripping maneuver.

Figure 6:
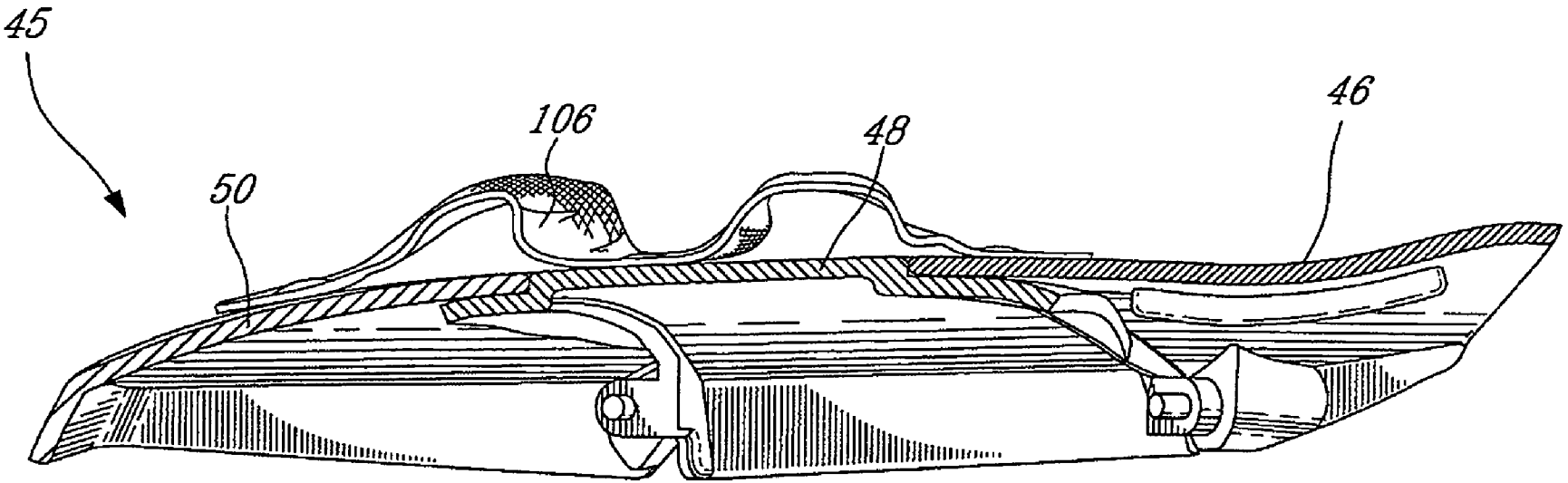
FIG. 6 is a cross-sectional view of the part of FIG. 3, taken along a longitudinal axis thereof, shown with an optional retaining strap attached thereto.
Figure 7:
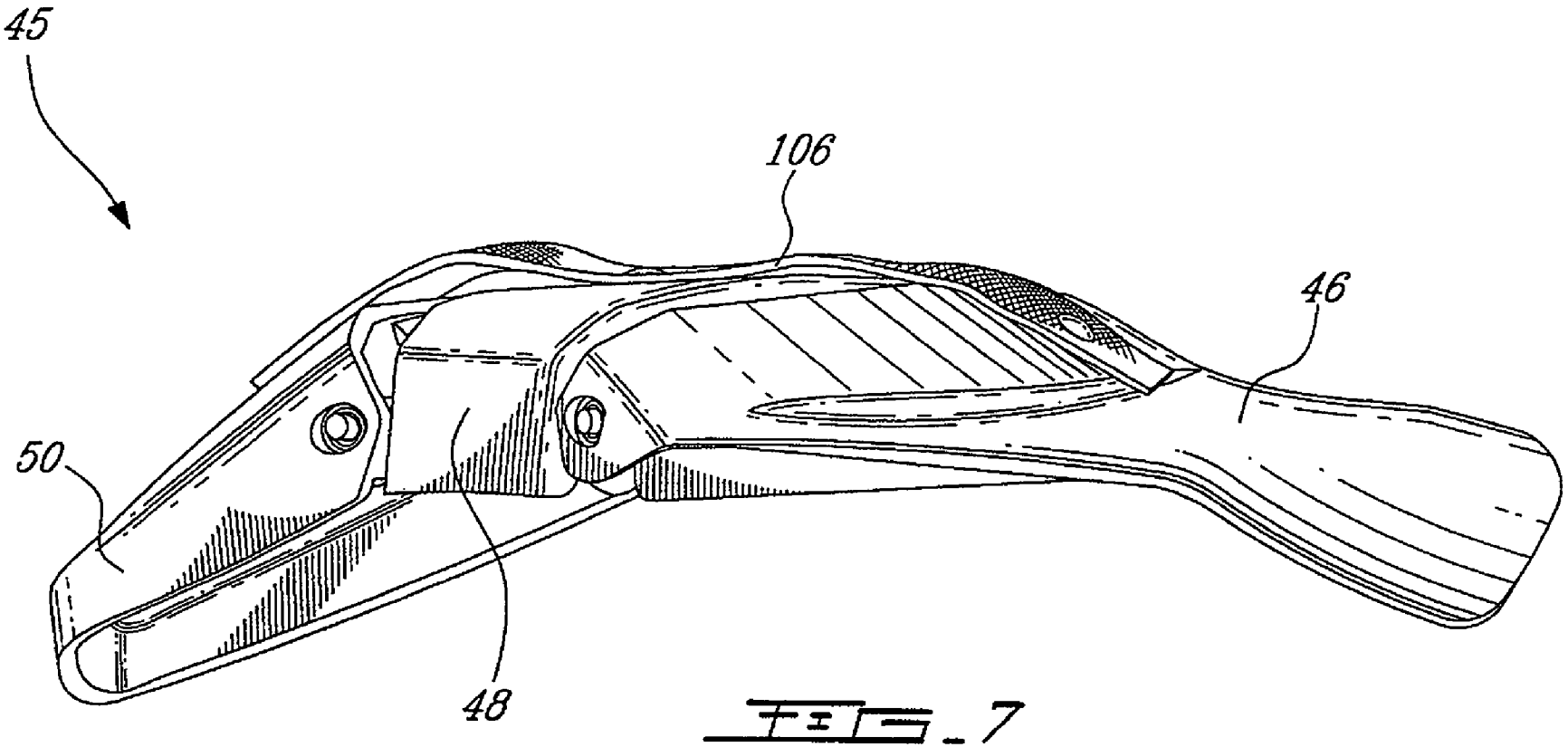
FIG. 7 is a side view of the part of FIG. 6 partially folded toward a folded position thereof.

Referring to FIGS. 6-7, a retaining strap 106 can optionally interconnect the frames 46, 48, 50 to limit a relative folding motion thereof. As shown in FIG. 6, when the frames 46, 48, 50 are aligned, the strap 106 loosely extends between the adjacent frames. As the thumb is folded toward the folded position, the retaining strap 106 becomes more tensioned, as illustrated in FIG. 7. The length of strap 106 extending between the frames 46, 48, 50 is selected such that the strap 106 extends tightly when the thumb is at a maximum desired folded position to prevent the thumb from folding further. The strap 106 is preferably connected to each frame 46, 48, 50, but can alternately be connected only to the base and tip frames 46, 50. Alternately, other adequate types of retaining members can replace the strap 106.

The angled break lines 94, 98 and axes of rotation 96, 100 allow the thumb portion 16 to fold in a non-linear manner, in a direction corresponding more accurately to the normal folding motion of a thumb when in position to grip a stick, thus improving the range of motion for the wearer of the glove 10 during play.

In a particular embodiment and as shown in FIG. 2, the thumb portion 16 folds toward the index portion 14*a* such as to be on the side thereof opposite that of the middle finger portion 14*b*.

Although the frames 46, 48, 50 have been described as rigid, in an alternate embodiment the frames 46, 48, 50 are partially or completely made of padding material.

Alternately, the frames 46, 48, 50 can be replaced by two similarly articulated frames. The pivots 60, 76 can also be replaced by other types of connecting members allowing a folding motion between adjacent ones of the frames, such as for example a flexible connector which can be made of fabric.

The embodiments of the invention described above are intended to be exemplary. Those skilled in the art will therefore appreciate that the foregoing description is illustrative only, and that various alternate configurations and modifications can be devised without departing from the spirit of the present invention. Accordingly, the present invention is intended to embrace all such alternate configurations, modifications and variances which fall within the scope of the appended claims.

The invention claimed is:

1. A protective glove having a thumb portion for receiving a thumb therein, the thumb portion comprising at least two dorsal protective members for protecting a back portion of a thumb, adjacent ones of the dorsal protective members being pivotable with respect to one another about a respective single axis of rotation between an extended position and a folded position, each axis of rotation being angled with respect to a respective transversal axis extending perpendicularly to a longitudinal axis of the thumb portion.

2. The glove according to claim 1, wherein each respective axis of rotation forms an angle of at least 20 degrees with the respective transversal axis.

3. The glove according to claim 1, wherein the adjacent ones of the dorsal protective members are interconnected by at least one pivot.

4. The glove according to claim 1, wherein the dorsal protective members include a rigid frame.

5. The glove according to claim 1, wherein the dorsal protective members include padding.

6. The glove according to claim 1, wherein the dorsal protective members include a rigid frame and padding material on an underside of the rigid frame.

7. The glove according to claim 1, wherein a gap is created between the adjacent ones of the dorsal protective members rotated in the folded position, the gap being at least substantially closed in the extended position, and the glove further comprising an extensible material interconnecting the adjacent ones of the dorsal protective members across the gap.

8. The glove according to claim 1, wherein the at least two dorsal protective members include tip, central and base protective members, the tip protective member being pivotable with respect to the central protective member, and the central protective member being pivotable with respect to the base protective member.

9. The glove according to claim 8, wherein the central protective member is directly connected on one side thereof to the base protective member by at least a first pivot and on an opposite side thereof to the tip protective member by at least a second pivot.

10. The glove according to claim 8, wherein the axis of rotation between the central protective member and the base protective member extends at a first angle with respect to the respective transversal axis and the axis of rotation between the central protective member and the tip protective member extends at a second angle with respect to the respective transversal axis, the first angle being larger than the second angle.

11. The glove according to claim 10, wherein the first and second angles are at least 20 degrees.

12. The glove according to claim 11, wherein the first angle is at least 45 degrees.

13. The glove according to claim 1, wherein at least one of the dorsal protective members includes at least one of a stopping member preventing the protective members from rotating away from the folded position beyond the extended position and a retaining member preventing the protective members from rotating away from the extended position beyond the folded position.

14. The glove according to claim 1, wherein the dorsal protective members have a curved cross-section such as to also protect at least part of opposed side portions of the thumb.

15. A protective glove including a thumb portion for receiving and protecting a thumb, the thumb portion including three protective members providing impact protection to a dorsal side of the thumb, adjacent ones of the protective members being connected through a pivot connection defining a respective one of first and second axes of rotation to articulate the thumb portion between a folded position and an extended position, the first and second axes of rotation being non-parallel to one another such that the protective members pivot toward the folded position in a non-linear manner.

16. The glove according to claim 15, wherein each axis of rotation is angled with respect to a respective transversal axis, the respective transversal axis being perpendicular to a longitudinal axis of the thumb portion.

17. The glove according to claim 15, wherein the three protective members include tip, central and base protective members, the central protective member is pivotable with respect to the base protective member about the first axis of rotation extending at a first angle with respect to a respective transversal axis defined perpendicularly to a longitudinal axis of the thumb portion, the tip protective member is pivotable with respect to the central protective member about the second axis of rotation extending at a second angle with respect to a respective transversal axis defined perpendicularly to the longitudinal axis, and the first angle is larger than the second angle.

18. The glove according to claim 15, wherein each protective member include a rigid frame, with rigid frames of adjacent ones of the protective members being pivotally interconnected.

19. The glove according to claim 15, wherein break lines defined between adjacent ones of the protective members are angled with respect to a transversal axis, the transversal axis being perpendicular to a longitudinal axis of the thumb portion.

* * * * *